US008182216B2

(12) United States Patent
Lhoest

(10) Patent No.: US 8,182,216 B2
(45) Date of Patent: May 22, 2012

(54) CONNECTING SYSTEM WITH JAWS OF TWO FERRULES, INCLUDING A COMPRESSOR

(75) Inventor: Andre Lucien Jacques Lhoest, Huy (BE)

(73) Assignee: Techspace Aero, Milmort Herstal (BE)

( * ) Notice: Subject to any disclaimer, the term of this patent is extended or adjusted under 35 U.S.C. 154(b) by 1147 days.

(21) Appl. No.: 11/964,380

(22) Filed: Dec. 26, 2007

(65) Prior Publication Data

US 2008/0159859 A1 Jul. 3, 2008

(30) Foreign Application Priority Data

Dec. 27, 2006 (EP) ..... 06127255

(51) Int. Cl.
*F04D 29/52* (2006.01)
*F04D 29/64* (2006.01)
*F01D 25/24* (2006.01)

(52) U.S. Cl. ..... 415/213.1; 415/214.1

(58) Field of Classification Search ..... 415/134, 415/199.1, 199.2, 199.4, 199.5, 213.1, 214.1
See application file for complete search history.

(56) References Cited

U.S. PATENT DOCUMENTS 2,716,563 A * 8/1955 Seneschall ..... 285/364
2,766,963 A 10/1956 Zimmerman
2,809,057 A * 10/1957 McEachern ..... 285/187
4,840,026 A * 6/1989 Nash et al. ..... 60/770
4,951,973 A * 8/1990 Corsmeier ..... 285/24
6,575,697 B1 6/2003 Arilla et al.
7,018,173 B2 * 3/2006 Bongrand et al. ..... 415/190
2003/0175113 A1 9/2003 Miwata et al.
2005/0118020 A1 * 6/2005 Kirk ..... 415/214.1

FOREIGN PATENT DOCUMENTS

EP 1 099 826 A1 5/2001

OTHER PUBLICATIONS

U.S. Appl. No. 11/964,184, filed Dec. 26, 2007, Delobel, et al.
U.S. Appl. No. 11/965,225, filed Dec. 27, 2007, Cortequisse, et al.

* cited by examiner

*Primary Examiner* — Nathaniel Wiehe
(74) *Attorney, Agent, or Firm* — Oblon, Spivak, McClelland, Maier & Neustadt, L.L.P.

(57) ABSTRACT

A system for connecting two ferrules in an axial compressor case is disclosed. Each of the ferrules includes a substantially annular flange with a proximal face adapted to be integral with the ferrule, and a distal face. The system further includes securing members for clamping distal faces of both flanges one against the other. The securing members include at least one pair of jaws provided for being connected by a set of tensile members, each of the jaws of the pair being provided for abutting against the proximal face of one of the flanges. At least one jaw of the pair further includes a portion, such as substantially radial shoulders, provided for forming a positive connection with complementary portions in both flanges for a transmission of circumferential stresses between both flanges.

12 Claims, 2 Drawing Sheets

CONNECTING SYSTEM WITH JAWS OF TWO FERRULES, INCLUDING A COMPRESSOR

BACKGROUND OF THE INVENTION

1. Field of the Invention

The present invention relates to a system for connecting two substantially tubular members, particularly two ferrules of an axial compressor case.

2. Description of the Related Art

Axial compressors, for example, in turbojets, are generally made of an axial sequence of rotors and stators. Each rotor is a set of rotary blades secured to the driving shaft of the compressor. Each stator is a set of stationary rectifying vanes secured to the compressor case. Each rotor is followed by a stator, so as to form a compressor stage.

A turbojet can comprise a plurality of successive compressors, for example, a low pressure compressor mounted in front of a high pressure compressor, wherein each comprises a different driving shaft.

Generally, an axial compressor case is formed by a set of substantially tubular members, also called ferrules, successively connected. Each ferrule generally surrounds a compressor stage, i.e. a rotor and a stator A ferrule will thus normally comprise the set of stationary vanes forming the stator, or means for securing said stationary vanes, as well as a abradable inner surface so as to avoid an excessive friction with the rotor blades.

The pairs of successive ferrules are connected via connecting means comprising:

a) two flanges, each being substantially annular and comprising a proximal face intended to be integral with one of both successive ferrules and a distal face, and b) securing members for pressing the distal faces of both flanges one against the other, so as to be able to transmit tensile and compression axial stresses between both flanges.

As used herein, distal face means the most remote face of the ferrule body, whereas proximal face means the nearest one of the ferrule body. In the state of the art, there are used as securing members bolts crossing holes provided in the flanges. However, such an arrangement has several inconvenients.

Should one of the compressor blade or vane break, significant circumferential stresses will become added to the axial and radial stresses between the pairs of adjacent ferrules. Such stresses have a shearing effect on the bolts of the connecting system, requiring the use of a large number of bolts with a considerable diameter for connecting ferrules. With the aim to solve the problem of the too numerous bolts, it is necessary to oversize the flanges by increasing the external diameter.

In addition to the cost and weight inconvenients resulting from such an oversizing, the radial bulk of enlarged flanges also results in other problems. So, in numerous applications, such a bulk makes the assembling and disassembling operations difficult, because of interferences between flanges and members outside the compressor, such as, for example, hoods. More particularly, in the field of turbojets, it could be desirable to be able to disassemble the low pressure compressor at the rear in order to make the maintenance easier. However, if the connecting flanges of the ferrules of the compressor case are too bulky, they will abut against the intermediate case, generally provided at the back of the low pressure compressor and used for supporting the whole turbojet.

This invention has also the object of overcoming the inconvenients of the state of the art providing a system for connecting tubular members allowing to minimise the radial bulk of such a system, particularly in the case of ferrules of an axial compressor case.

BRIEF SUMMARY OF THE INVENTION

In order to overcome such a problem, this invention provides a connecting system, as indicated in the opening paragraph, wherein two securing members comprise at least one pair of jaws arranged so as to be connected by a set of tensile members, for example, screws or bolts, each of the jaws of said pair being arranged so as to abut against the proximal face of one of the flanges, and a jaw of said pair further comprising means, such as substantially radial shoulders, provided so as to form a positive connection with complementary means in both flanges for a transmission of circumferential stresses between both flanges.

Thereby, it is possible to decoupling tensile and compression axial stresses of shearing circumferential stresses between both flanges. Tensile members connecting at least one pair of jaws could thereby be dimensioned simply depending on tensile axial stresses between both flanges, while shearing circumferential stresses could be compensated for on a larger transversal surface by one of said pair of jaws without requiring to excessively broaden the external diameter of flanges.

Preferably, each of both flanges comprises at least one substantially radial cut, and one of the jaws of said pair is arranged so as to form a positive connection with the cut of each of both flanges for said transmission of circumferential stresses between both flanges. This makes it possible to provide for a particularly efficient positive connection for the transmission of shearing circumferential stresses without requiring to excessively broaden the flange diameters.

Preferably, the connecting system further comprises centering means for ensuring radial stresses between both flanges. This allows for decoupling, in turn, radial stresses from axial and circumferential stresses and to dimension such centering means specifically for ensuring radial stresses without influencing the bulk of transmission means of the other stresses.

Preferably, the proximal face of at least one of said both flanges comprises a tilted or tapered surface being adapted to come into contact with one of said pair of jaws in order to retain it radially by a positive binding, and thereby prevent the pair of jaws from sliding up to loosing the contact with flanges, and therefore, the axial connection.

Preferably, at least one of the jaws is adapted for supporting a hood or a streamlined body external to the substantially tubular members, for example, a compressor nose in a double flow turbojet, allowing thus to simplify the support of such external hoods or streamlined bodies and to facilitate assembling and disassembling of such an assembly.

Preferably, such a support is provided with a boss arranged in said jaw so as to accommodate an insert or a rivet nut for securing said hood or streamlined body, thus implementing a solid, although removable, support without requiring to increase the radial bulk of the connecting system.

Alternatively, said at least one jaw is integrated into said hood or streamlined body so as to reduce the number of parts, with the advantages of a lower cost and higher reliability and simplicity.

The present invention also relates to an axial compressor case, for example, of a low pressure compressor of a turbojet or a turboprop, comprising a plurality of ferrules, two of which are adjacent and connected by a connecting system according to this invention, as well as a method for using such a connecting system in such a case. This provides an axial compressor case with a low radial bulk and, thus, more easily dismantled.

Preferably, at least one of said two adjacent ferrules comprises a stator and/or an abradable inner surface, so as to integrate such compressor members into the case.

BRIEF DESCRIPTION OF THE SEVERAL VIEWS OF THE DRAWINGS

Details relative to the invention are described hereinunder referring to drawings.

DETAILED DESCRIPTION OF THE INVENTION

Figure 1:
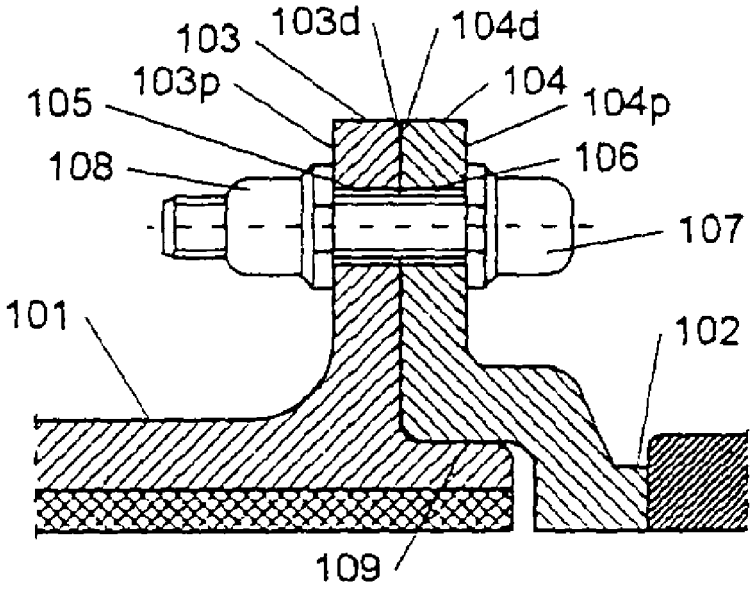
Fig. 1 BACKGROUND ART
FIG. 1 is a lengthwise sectional view of the state of the art.

As can be seen on FIG. 1, in the state of the art, each of the ferrules 101 and 102 of a low pressure compressor case in a double flow turbojet comprises a flange, respectively designated by 103 and 104. Each of said flanges 103, 104 has a proximal face, respectively designated by 103*p* and 104*p*, and a distal face, respectively designated by 103*d* and 104*d*. In each flange 103, 104, a set of holes, respectively designated by 105 and 106, connect the proximal face 103*p*, 104*p* to the distal face 103*d*, 104*d*. The holes 105 in the flange 103 are aligned with the holes 106 of the flange 104, so as to be able to have screws 107 crossing therethrough. By clamping such screws 107 with nuts 108, it is thus possible to establish an axial connection between ferrules 101 and 102.

Whereas the transmission of radial stresses is ensured by the interlocking of the centering surfaces 109 of the ferrules 101, 102, the bolts 107 are to compensate, in addition to the axial traction, for the circumferential torsion between flanges 103, 104. Such a torsion submit the bolts 107 to shearing stresses, requiring to increase their working section, and therefore, the diameter of the holes 105, 106 and the height of the flanges 103, 104.

Figure 2:
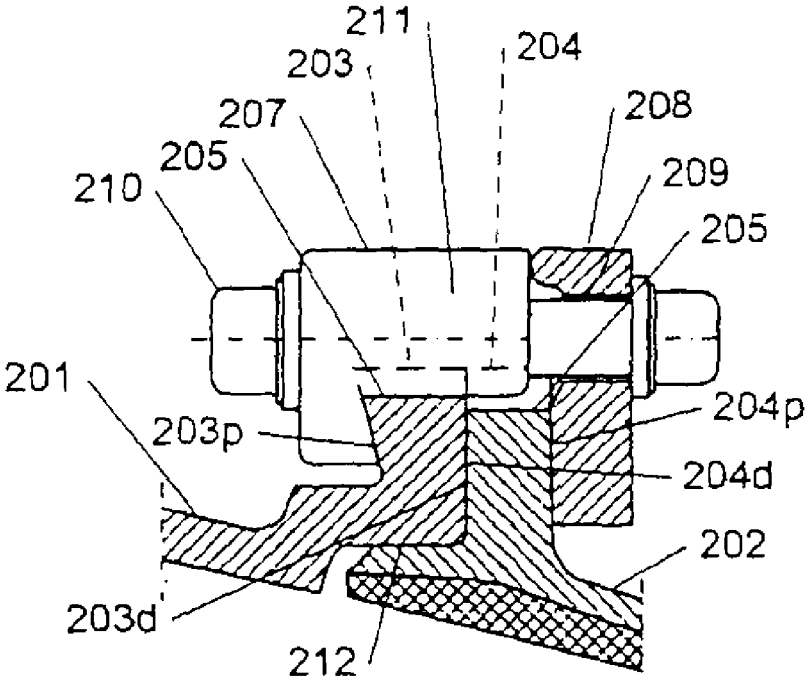
FIG. 2 is a lengthwise sectional view of a connecting system according to an embodiment of the invention.
Figure 3:
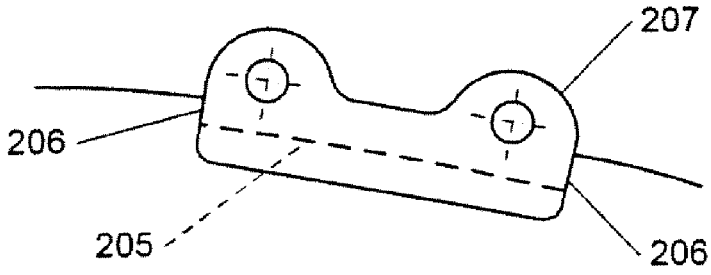
FIG. 3 is a front view of the same connecting system.

In the embodiment of this invention illustrated in FIG. 2, each of the ferrules 201, 202 comprises a flange, respectively designated by 203 and 204. Each of the flanges 203, 204 comprises a distal face, respectively designated by 203*d* and 204*d*, substantially perpendicular to the axis of the corresponding ferrule 201, 202, and a substantially tapered proximal face, respectively designated by 203*p* and 204*p*. Each of the flanges 203, 204 further comprises a plurality of cuts 205 distributed around the circumference of each flange 203, 204. Each cut 205 comprises two substantially radial edges 206. The cuts 205 of the flange 203 are adapted to be aligned with the cuts 205 of the other flange 204 when the ferrules 201, 202 are connected.

The illustrated connecting system further comprises a pair of jaws 207, 208 connected by screws 209 retained by nuts 210. One jaw 207 abuts against the proximal face 203*p* of a flange 203, while the other jaw 208 abuts against the proximal face 204*p* of the other flange 204. In such a way, by clamping the screws 209 in the nuts 210, it is possible to clamp the jaws 207, 208, so tightening the flanges 203, 204. Such an axial prestress of the flanges 203, 204 allows to transmit via the distal faces 203*d*, 204*d*, axial stresses in compression between the ferrules 201, 202, and via the bolts 209 tensile axial stresses. Simultaneously, the tapered shape of the proximal faces 203*p*, 204*p* ensures the radial retention of the pair of jaws 207, 208 when the bolts 209 are clamped.

Alternatively, only one of the faces of the flanges 203 could have a tapered shape corresponding to a single conical jaw 207, as represented on FIG. 2.

The jaw 207 comprises an axial extension 211 such that the contact area between both flanges 203*d*, 204*d* is located under such an extension. The axial extension 211 is housed in the aligned cuts 205 of both flanges 203, 204. Thereby, such an extension 211 forms a positive connection with the edges 206 of both cuts, allowing to transmit torsion circumferential stresses between both flanges 203, 204. The jaw 207 has a shearing working section higher than that of the screws 107 of the state of the art without requiring to broaden the diameter of the flanges 203, 204. The screws 209 connecting the jaws 207, 208 are therefore substantially free from shearing stresses and could be dimensioned with a considerably reduced section as compared with the bolts 107 of the state of the art illustrated on FIG. 1.

The torsion circumferential stresses between flanges 203, 204 could however, according to other embodiments, be transmitted by other positive connexions. For example, the jaws 207, 208 could both have extensions, each of such extensions being housed in the cut 205 of each of the flanges 203, 204, so that each of them forms a positive connection with the edges 206 of each cut 205, and said extensions have, in turn, substantially radial and complementary shoulders so as to transmit shearing stresses between both jaws 207, 208. The flat parts of the cuts 205 of flanges could optionally have a radial play with the corresponding faces of the jaws 207 and/or 208, as represented on FIG. 2 for cutting the flange 204.

The transmission of radial stresses is ensured, as in the state of the art illustrated on FIG. 1, through the interlocking of centering surfaces 212 of ferrules 101, 102.

In addition, when the proximal faces of the flanges 203*p*, 204*p* are tapered, the radial stress is compensated for by screws 209 as an axial stress.

Figure 4:
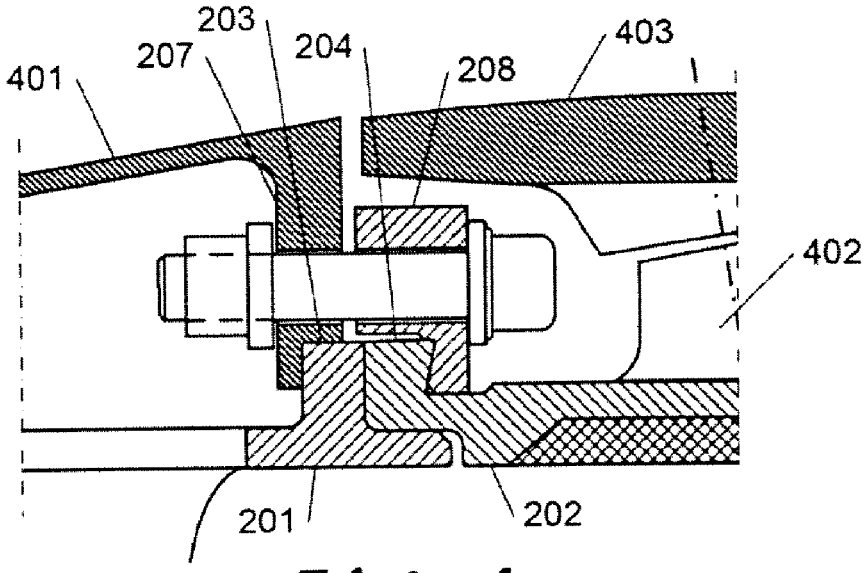
FIG. 4 is a lengthwise sectional view of a connecting system according to an alternative embodiment of the invention.

Turning now to FIG. 4, an alternative embodiment is illustrated, where two ferrules 201, 202 of a low pressure compressor case are also connected by flanges 203, 204. The ferrule 201 acts as a support for the separation nose of the compressor, having an axisymmetrical geometry and being centered on the ferrule 201. Flanges 203, 204 are retained by a pair of jaws 207, 208 connected by screws 209 and nuts 210. In this alternative embodiment, the jaws 207 is integrated into a separation nose of the compressor 401. Thereby, the separation lip of the compressor 401, forming a streamlined body separating the primary flow from the secondary flow, can be supported by the low pressure compressor case without requiring to use a boss on the ferrule 201 analogous to the boss 402 formed on the ferrule 202 for supporting the hood 403 extending the compressor nose 401.

In FIG. 4, the ferrule 202 comprises bosses 402 for supporting the hood 403 extending the separation nose of the compressor 401. The inconvenient of such bosses formed on the ferrules for supporting hoods or streamlined bodies lies in that they broaden the ferrule external diameter, making their assembling and disassembling more difficult because of possible interferences with members external to the compressor case.

Figure 5:
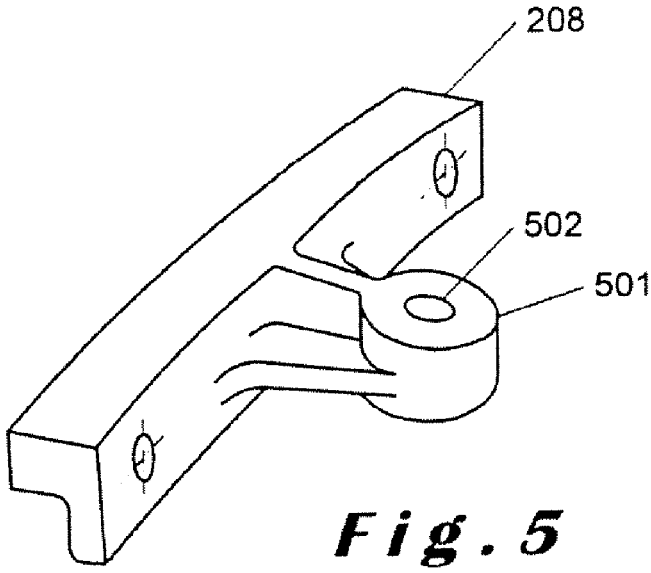
FIG. 5 is a perspective view of a jaw of a connecting system according to an alternative embodiment.

It would thereby be also advantageous to substitute the boss 402 of the embodiment as presented in FIG. 4 by means as illustrated in FIG. 5. In said FIG. 5 is illustrated a jaw 208 adapted to substitute for the jaw 208 in FIG. 4, on which is formed a boss 501 provided with a hole 502 intended to accommodate a bolt, a screw, an insert or a rivet for supporting a hood or a streamlined body. Such a jaw and the flange 204 should not necessarily have a tapered shape, as the radial retention of the jaw is ensured by securing it to the axisymmetrical part 207.

In all the illustrated embodiments, the connecting system could be mounted temporarily connecting ferrules 201, 202 by Colson collars before placing jaws 207, 208, and/or disassembled temporarily connecting ferrules 201, 202 with Colson collars before removing jaws 207, 208.

Although the present invention has been described referring to specific embodiments, it is understood that various modifications and changes could be implemented on such examples without departing from the general scope of the invention such as defined by the claims. Consequently, the description and the drawings should be considered in an illustrative way, rather than a descriptive one.

FIGURE LEGENDS

101: Ferrule
102: Ferrule
103: Flange
103*p*: Proximal face
103*d*: Distal face
104: Flange
104*p*: Proximal face
104*d*: Distal face
105: Hole
106: Hole
107: Screw
108: Nut
109: Centering surfaces
201: Ferrule
202: Ferrule
203: Flange
203*p*: Proximal face
203*d*: Distal face
204: Flange
204*p*: Proximal face
204*d*: Distal face
205: Cut
206: Edge
207: Jaw
208: Jaw
209: Screw
210: Nut
211: Extension
212: Centering surfaces
401: Separation nose of the compressor
402: Boss
403: Hood
501: Boss
502: Hole

The invention claimed is:

1. A system for connecting first and second substantially tubular ferrules of an axial compressor case, comprising:

a first flange being substantially annular and comprising a proximal face which is integral with the first ferrule, and a distal face;

a second flange being substantially annular and comprising a proximal face which is integral with the second ferrule, and a distal face; and securing members for pressing the distal faces of the first and second flanges against each other, so as to be able to transmit tensile and compression axial stresses between both flanges, said securing members including first and second jaws which are connected by a tensile member, wherein the first jaw includes a distal face which abuts against the proximal face of the first flange, and the second jaw includes a distal face which abuts against the proximal face of the second flange, and wherein the first jaw includes first and second substantially radial shoulders which abut corresponding radial shoulders of each of the first and second flanges for a transmission of circumferential stresses between the first and second flanges.

2. The connecting system according to claim 1, wherein each of the flanges comprises at least one substantially radial cut, and the first jaw is arranged so as to form a positive connection with the cut of each of the flanges for said transmission of circumferential stresses between both flanges.

3. The connecting system according to claim 1, further comprising centering means for compensating radial stresses between both flanges.

4. The connecting system according to claim 1, wherein the proximal face of at least one of said flanges comprises a tilted or conical surface adapted for being in contact with one of said jaws in order to radially retain it by a positive link.

5. The connecting system according to claim 1, wherein at least one of the jaws is arranged so as to support a hood or a streamlined body external to substantially tubular members.

6. The connecting system according to claim 5, wherein said jaw comprises a boss provided so as to accommodate an insert or a rivet bolt for securing said hood or streamlined body.

7. The connecting system according to claim 5, where said jaw is integrated into said hood or streamlined body.

8. The connecting system according to claim 1, wherein the first jaw includes an axial extension, and a contact area between the distal faces of the first and second flanges is located under the axial extension.

9. An axial compressor case, comprising a plurality of ferrules, two of which are adjacent and connected by a connecting system according to claim 1.

10. The axial compressor case according to claim 9, wherein at least one of said two adjacent ferrules comprises a stator and/or an abradable inner surface.

11. A method of connecting, comprising:

connecting at least two adjacent ferrules of an axial compressor case with the connecting system according to claim 1.

12. The method according to claim 11, wherein at least one of said both adjacent ferrules comprises a stator and/or an abradable inner surface.

* * * * *